US011462808B2

(12) United States Patent
Roos et al.

(10) Patent No.: US 11,462,808 B2
(45) Date of Patent: Oct. 4, 2022

(54) CONFORMABLE WAVEGUIDE HAVING AN OBROUND CROSS SECTION, A TOOL FOR MANUALLY CONFORMING AN OBROUND WAVEGUIDE AND A METHOD FOR FORMING THE CONFORMABLE WAVEGUIDE

(71) Applicant: Roos Instruments, Inc., Santa Clara, CA (US)

(72) Inventors: Mark Roos, San Carlos, CA (US); Ray Beers, San Jose, CA (US); Rick Rodriguez, Brentwood, CA (US)

(73) Assignee: Roos Instruments, Inc., Santa Clara, CA (US)

( * ) Notice: Subject to any disclaimer, the term of this patent is extended or adjusted under 35 U.S.C. 154(b) by 44 days.

(21) Appl. No.: 16/878,474

(22) Filed: May 19, 2020

(65) Prior Publication Data

US 2021/0367316 A1 Nov. 25, 2021

(51) Int. Cl.

| | |
|---|---|
| ***H01P 3/127*** | (2006.01) |
| ***H01P 11/00*** | (2006.01) |
| ***H01P 3/14*** | (2006.01) |

(52) U.S. Cl.

CPC ..... *H01P 3/127* (2013.01); *H01P 3/14* (2013.01); *H01P 11/002* (2013.01)

(58) Field of Classification Search

CPC .. H01P 3/14; H01P 3/127; H01P 3/123; H01P 3/12; H01P 11/002; H01P 9/02

USPC ..... 333/239, 241

See application file for complete search history.

(56) References Cited

U.S. PATENT DOCUMENTS

| | | | | |
|---|---|---|---|---|
| 3,585,540 | A * | 6/1971 | Schuttloffel et al. ..... | H01P 3/14 333/241 |
| 3,659,234 | A * | 4/1972 | Schuttloffel et al. ..... | H01P 3/14 333/241 |
| 3,772,772 | A * | 11/1973 | Lehnert ..... | H01P 3/14 29/600 |
| 3,813,765 | A * | 6/1974 | Prinzhorn et al. .... | H01P 11/002 29/600 |

* cited by examiner

*Primary Examiner* — Benny T Lee

(57) ABSTRACT

A conformable waveguide for conveyance of high frequency radio signals including a hollow component having a smooth interior surface and an obround cross section, the obround cross section defined as having parallel opposing sides connected by two rounded opposing ends, where the parallel opposing sides are separated by a first distance, where vertices of the two rounded opposing ends are separated by a second distance, and where the second distance is greater than the first distance.

22 Claims, 6 Drawing Sheets

CONFORMABLE WAVEGUIDE HAVING AN OBROUND CROSS SECTION, A TOOL FOR MANUALLY CONFORMING AN OBROUND WAVEGUIDE AND A METHOD FOR FORMING THE CONFORMABLE WAVEGUIDE

BACKGROUND

Radio frequency (RF) waveguides are used for conveying radio signals at millimeter band frequencies. At high frequencies (e.g., 30 Gigahertz (GHz) through 140 GHz), a waveguide is considered the only practical signal transmission medium. Examples of applications operating at such high frequencies include automotive radar and 5G wireless communication. For example, automotive applications are requiring increased use of RF/microwave frequency bands, from low RF signals through millimeter-wave frequencies at 75-90 GHz. As these high-frequency signals become more integral parts of the worldwide driving experience, effective test solutions become more critical for designers developing new automotive RF/microwave circuits, as well as production facilities seeking efficient methods for verifying the performance of these added circuits. A growing concern in automotive markets is for the accurate and cost-effective testing of 75-90 GHz automotive radar systems. This interest stems from the fact that historically, measurement equipment at such high frequencies has neither been commonplace nor cost-effective.

A number of different automotive radar-based safety applications make use of frequencies from 75-90 GHz, for adaptive cruise control (ACC), blind-spot detection (BSD), emergency braking, forward collision warning (FCW), cross traffic alert (CTA), lane change assist (LCA), and rear collision protection (RCP). For example, in a collision warning system, an automotive radar sensor can detect and track objects within the range of the transmitted and returned radar signals, automatically adjusting a vehicle's speed and distance in accordance with the detected targets. Different systems can provide a warning of a potential collision ahead and also initiate procedures leading to emergency braking as required.

Typical automotive radar chipsets may include dozens of high frequency RF ports dedicated to the various radar-based applications described above. Each of these high frequency RF ports requires performance and production testing. As such, each high frequency RF port requires a dedicated waveguide for conveying signals to and from a test system. As the density of high frequency RF ports increases, the manufacture and customization of waveguides of conventional test equipment becomes increasing impractical and, in some cases, essentially impossible.

BRIEF DESCRIPTION OF THE DRAWINGS

The accompanying drawings, which are incorporated in and form a part of the Detailed Description of Embodiments, illustrate various embodiments of the subject matter and, together with the Detailed Description of Embodiments, serve to explain principles of the subject matter discussed below. Unless specifically noted, the drawings referred to in this Brief Description of Drawings should be understood as not being drawn to scale. Herein, like items are labeled with like item numbers throughout the drawings.

DETAILED DESCRIPTION OF EMBODIMENTS

Figure 1A:
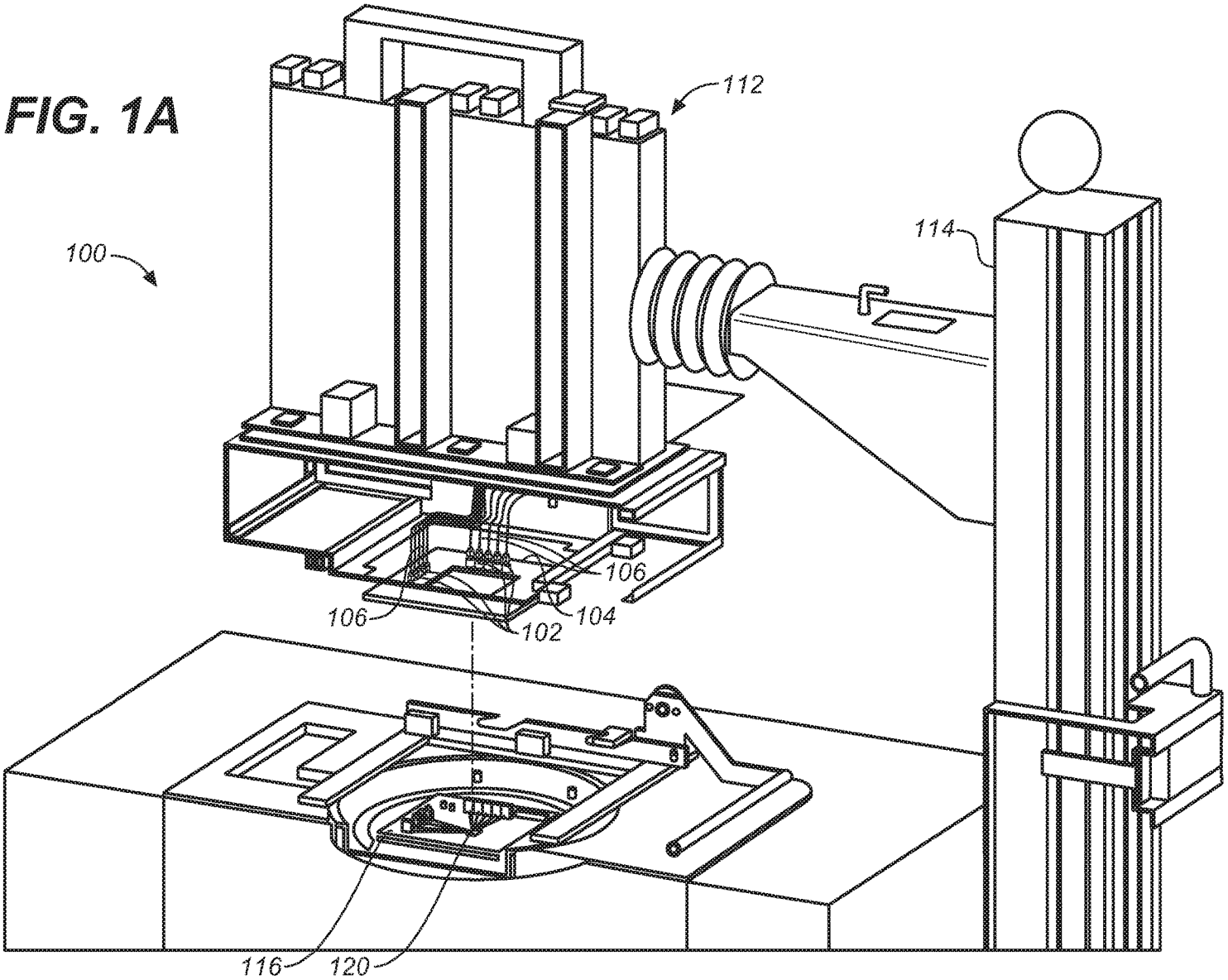
FIG. 1A illustrates a portion of an example test apparatus including a plurality of waveguides coupled to waveguide fixture, according to an embodiment.

The following Detailed Description of Embodiments is merely provided by way of example and is not intended to be exhaustive or to limit the embodiments to the precise form described. Instead, example embodiments in this Detailed Description of Embodiments have been presented in order to enable persons of skill in the art to make and use embodiments of the described subject matter. Furthermore, there is no intention to be bound by any expressed or implied theory presented in the preceding background or in the following Detailed Description of Embodiments.

Moreover, various embodiments have been described in various combinations. However, any two or more embodiments can be combined. Although some embodiments have been described in a language specific to structural features and/or methodological acts, it is to be understood that the subject matter defined in the appended claims is not necessarily limited to the specific features or acts described above. Rather, the specific features and acts described above are disclosed by way of illustration and as example forms of implementing the claims and their equivalents Reference will now be made in detail to various embodiments of the subject matter, examples of which are illustrated in the accompanying drawings. While various embodiments are discussed herein, it will be understood that the various embodiments are not intended to limit to these embodiments. On the contrary, the presented embodiments are intended to cover alternatives, modifications and equivalents, which may be included within the spirit and scope the various embodiments as defined by the appended claims. Furthermore, in this Detailed Description of Embodiments, numerous specific details are set forth in order to provide a thorough understanding of embodiments of the present subject matter. However, embodiments may be practiced without these specific details. In other instances, well known methods, procedures, components, and circuits have not been described in detail as not to unnecessarily obscure aspects of the described embodiments.

Notation and Nomenclature

Some portions of the detailed descriptions which follow are presented in terms of procedures, logic blocks, processing and other symbolic representations of operations for creating or using a manually conformable waveguide. These descriptions and representations are the means used by those skilled in the data processing arts to most effectively convey the substance of their work to others skilled in the art. In the present application, a procedure, block, process, or the like, is conceived to be one or more self-consistent procedures or instructions leading to a desired result. The procedures are those requiring physical manipulations of physical quantities. Usually, although not necessarily, these quantities take the form of high frequency (e.g., millimeter or microwave) signals capable of being transmitted and received by an electronic device and/or electrical or magnetic signals capable of being stored, transferred, combined, compared, and otherwise manipulated in an electrical device.

It should be borne in mind, however, that all of these and similar terms are to be associated with the appropriate physical quantities and are merely convenient labels applied to these quantities. Unless specifically stated otherwise as apparent from the following discussions, it is appreciated that throughout the description of embodiments, discussions utilizing terms such as "receiving," "bending," "conforming," "passing," "forming," "conveying," or the like, refer to the actions and processes of an electric device such as a metal rolling machine.

Overview of Discussion

Discussion begins with a description of an example manually conformable waveguide, in accordance with various embodiments. An example tool for enabling the manual conforming of a manually conformable waveguide is then described. Example operations for manufacturing a manually conformable waveguide are then described.

Embodiments described herein provide a conformable waveguide for conveyance of high frequency radio signals including a hollow component having a smooth interior surface and an obround cross section. An "obround cross section" is defined as having parallel opposing sides connected by two rounded opposing ends, wherein the parallel opposing sides are separated by a first distance, wherein vertices of the two rounded opposing ends are separated by a second distance, wherein the second distance is greater than the first distance.

In one embodiment, a ratio of the second distance to the first distance is between 1.5/1 and 2/1. In one embodiment, a ratio of the first distance to a thickness of the hollow component is between 10/1 and 20/1. In one embodiment, the two rounded opposing ends have semicircular cross sections. In another embodiment, the two rounded opposing ends have semielliptical cross sections. In another embodiment, the two rounded opposing ends have semioval cross sections. In one embodiment, the parallel opposing sides comprise depressions such that the conformable waveguide has a substantially epitrochoid cross section, where an epitrochoid is a plane curve traced by a point on the radius or extended radius of a circle rolling on the outside of a fixed circle.

A waveguide is essentially the only practical transmission media of radio signals at millimeter-wave frequencies (e.g., greater than 30 GHz) currently available for use. Other transmission media, such as coaxial cable, have very high loss and very high interconnect cost. As utilized herein, a waveguide is a carefully shaped hollow tube or component that "guides" a radio signal (e.g., radio wave) in the intended direction. The size and shape of the waveguide is critical for the application. Conventionally, a rectangular waveguide is the most practical and most common form of waveguide currently in use, where a rectangular waveguide is rectangular in cross section.

Furthermore, conventional waveguides are a rigid media. Typically, conventional waveguides require design and fabrication to designed specifications. To bend or conform a conventional waveguide, the waveguide must be filled with solid material (e.g., solder), then mandrel bent. After bending, the solid material must somehow be removed. This requires specialized equipment and techniques making conventional waveguides impractical for custom applications.

There are two main issues that render manual bending or forming of rectangular waveguide impractical. First, when bending, the rectangular shape physically distorts, adversely affecting the electrical performance. Second, the wall thickness makes bending difficult, given the geometry of the rectangular cross section. It should be appreciated that the above described issues are not isolated to rectangular waveguides, but are also observed in waveguides having circular, oval, or elliptical cross sections.

Embodiments described herein provide a new and improved form of waveguide that can easily be manually bent to any shape using only simple hand tools or no tools at all. The waveguide described herein has cross section of a particular obround shape that makes the waveguide bendable without significant distortion, and still preserves electrical performance. An obround waveguide has an obround cross section, generally defined as having rounded ends (e.g., an approximate semicircle) with straight or substantially straight sides in the middle. This shape may also be referred to as a "stadium" or "racetrack", due to the similarity to those shapes. It may also be referred to as a "discorectangle". It should be appreciated that the rounded ends may have semicircular cross sections, semielliptical cross sections (including either the major or minor axes), semioval cross sections, or other rounded or curved cross sections. As utilized herein, the term "obround" includes all of these embodiments.

Manually Conformable Waveguide

Embodiments described herein provide a conformable waveguide for conveyance of high frequency radio signals including a hollow component having a smooth interior surface and an obround cross section. One or more embodiments are now described with reference to the drawings, wherein like reference numerals are used to refer to like elements throughout. In the following description, for purposes of explanation, numerous specific details are set forth in order to provide a thorough understanding of the various embodiments. It may be evident, however, that the various embodiments can be practiced without these specific details.

As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. In addition, the word "coupled" is used herein to mean direct or indirect electrical or mechanical coupling. In addition, the word "example" is used herein to mean serving as an example, instance, or illustration.

FIG. 1A illustrates a portion of an example test apparatus 100, including a plurality of waveguides 106 coupled to waveguide fixture 104 via waveguide fixture connectors 102, according to an embodiment. As illustrated, test apparatus 100 includes a test head assembly 112 supported by a support arm 114. The test apparatus 100 is configured to test the radar chipset 120. The test head assembly 112 includes the waveguide fixture 104 for mating connection to the probe card holder 116. The probe card holder 116 in turn is connected to components on the radar chipset 120, including by millimeter waveguides to the radar receivers of radar chipset 120.

Figure 1B:
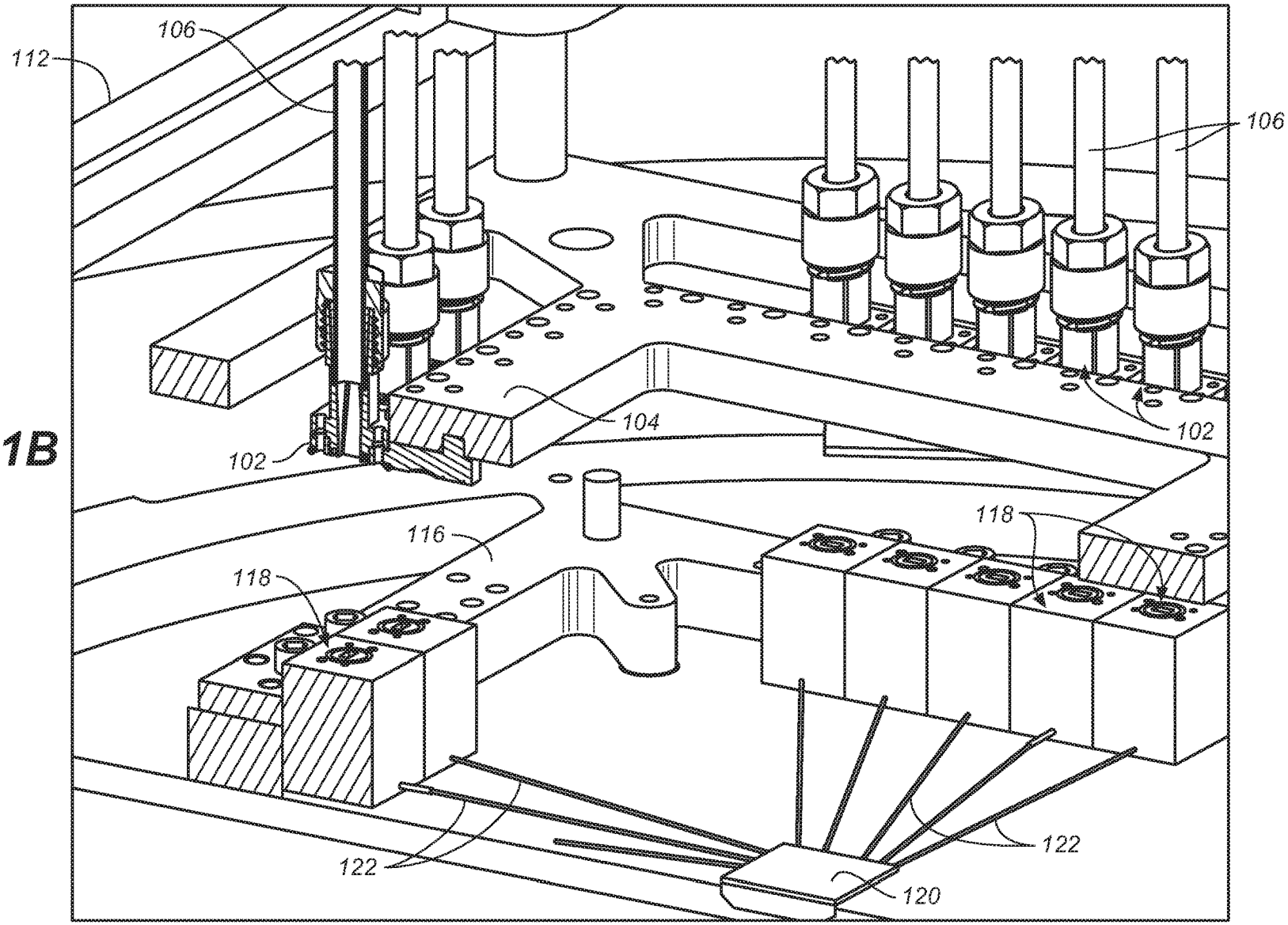
FIG. 1B illustrates further details of the waveguide fixture of FIG. 1A, according to an embodiment.

FIG. 1B illustrates further details of the waveguide fixture 104, which is coupled to the test head assembly 112, the probe card holder 116, the chipset 120, and waveguides 106, such as millimeter waveguides, to the chipset 120. In one embodiment, a plurality of waveguides 106 is mounted on the waveguide fixture 104 via a plurality of waveguide fixture connectors 102. Responsive to support arm 114 (from FIG. 1A) moving test head assembly 112 towards probe card holder 116, a waveguide fixture connector 102 (e.g., a blind mate waveguide flange) may mate with a corresponding element 118 on the probe card holder 116 upon the waveguide fixture 104 interfacing with probe card holder 116. Waveguide transmission lines 122 are coupled to the ends of elements 118 for connection to the chipset 120.

Figure 2A:
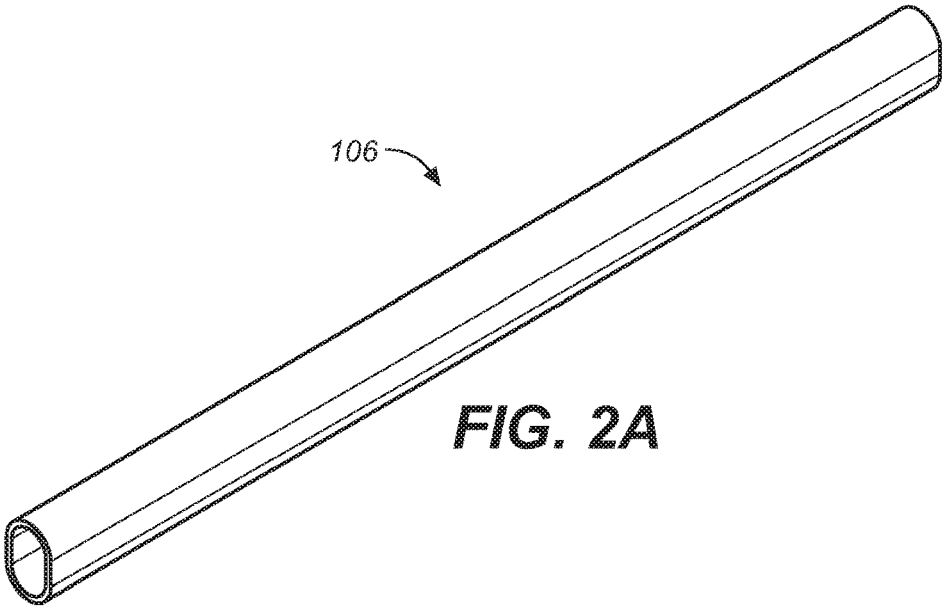
FIGS. 2A and 2B illustrate an example waveguide, according to various embodiments.
Figure 2B:
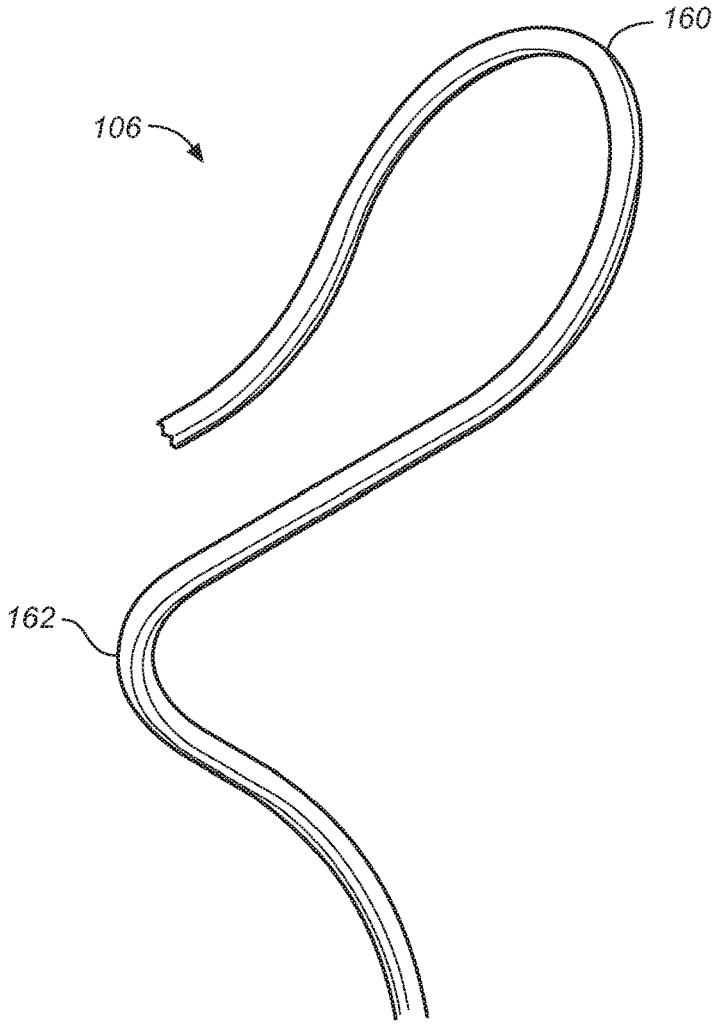

FIGS. 2A and 2B illustrate an example waveguide 106, according to various embodiments. Waveguide 106 is operable to convey high frequency radio signals at millimeter wave frequencies (e.g., between 30 GHz and 140 GHz). Waveguide 106 includes a hollow component having a smooth (e.g., non-corrugated) interior surface, upon which radio signals are reflected during conveyance. Waveguide 106 has an obround cross section. For purposes of the instance specification, an obround cross section defined as having parallel opposing sides connected by two rounded opposing ends, wherein the parallel opposing sides are separated by a first distance, wherein vertices of the two rounded opposing ends are separated by a second distance, wherein the second distance is greater than the first distance.

Waveguide 106 can be comprised of any bendable or conformable metal, including and without limitation: copper, aluminum, and brass. In some embodiments, the interior or exterior of waveguide 106 is coated with another metal, e.g., gold.

FIG. 2A illustrates an unbent segment of waveguide 106. FIG. 2B illustrates a bent segment of waveguide 106. Waveguide 106 is bent across the second distance, as indicated by arrow 160, and is bent across the first distance, as indicated by arrow 162. It should be appreciated that the bend indicated by arrow 160 may be referred to as a bend in the hard direction (e.g., H direction), as the bend is across the longer cross section axis of the obround cross section of waveguide 106, and that the bend indicated by arrow 162 may be referred to as a bend in the easy direction (e.g., E direction), as the bend is across the shorter cross section axis of the obround cross section of waveguide 106.

Figure 3A:
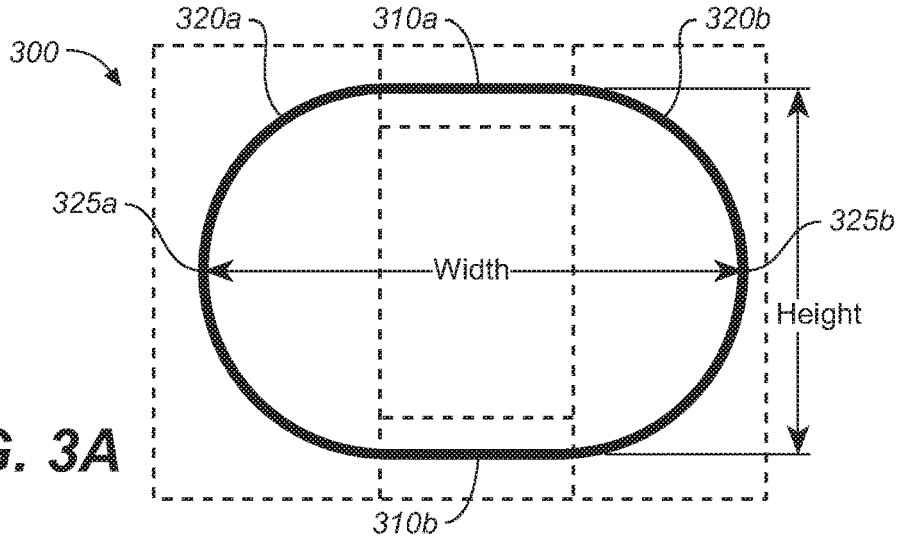
FIG. 3A illustrates an obround cross section of a waveguide, according to embodiments.

FIG. 3A illustrates an obround cross section 300 of a waveguide (e.g., waveguide 106 of FIGS. 2A and 2B), according to embodiments. Obround cross section 300 is defined by parallel opposing sides 310*a* and 310*b* and rounded opposing ends 320*a* and 320*b*. The parallel opposing sides 310*a* and 310*b* are separated by first distance, also referred to as "height." The vertices 325*a* and 325*b* of rounded opposing ends 320*a* and 320*b*, respectively, are separated by a second distance, also referred to as "width."

It should be appreciated that the ratio of width to height can be adjusted to balance electrical performance with mechanical conformability of the waveguide 106 of FIGS. 2A and 2B. A "fat" shape closer to a circle where parallel opposing sides 310*a* and 310*b* are short relative to the overall dimensions (e.g., where the height approaches the width) is easier to bend but has narrower bandwidth and can have frequency response issues due to propagation mode effects. A "thin" shape where parallel opposing sides 310*a* and 310*b* are long relative to the overall dimensions (e.g., where the width is at least three times the height) is difficult to bend without distorting or collapsing. In accordance with various embodiments, the width to height ratio of the waveguide is between 1.5/1 and 2.0/1.

Figure 3B:
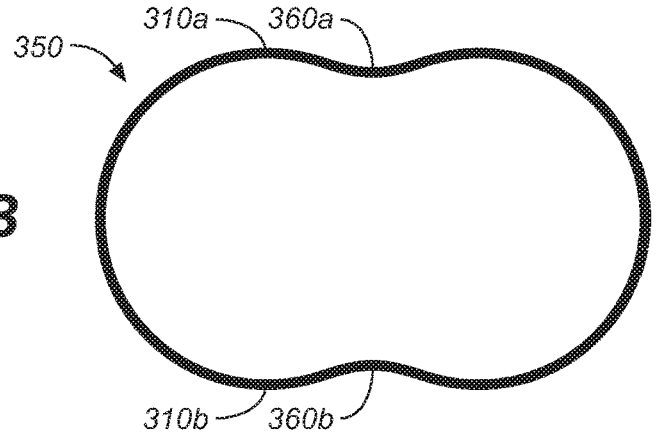
FIG. 3B illustrates an obround cross section 350 of a waveguide, according to other embodiments.

FIG. 3B illustrates an obround cross section 350 of a waveguide (e.g., waveguide 106), according to embodiments, where the parallel opposing sides 310*a* and 310*b* include depressions 360*a* and 360*b* into the hollow tube, such that the waveguide has a substantially epitrochoid cross section, where an epitrochoid is a plane curve traced by a point on the radius or extended radius of a circle rolling on the outside of a fixed circle.

Figure 4:
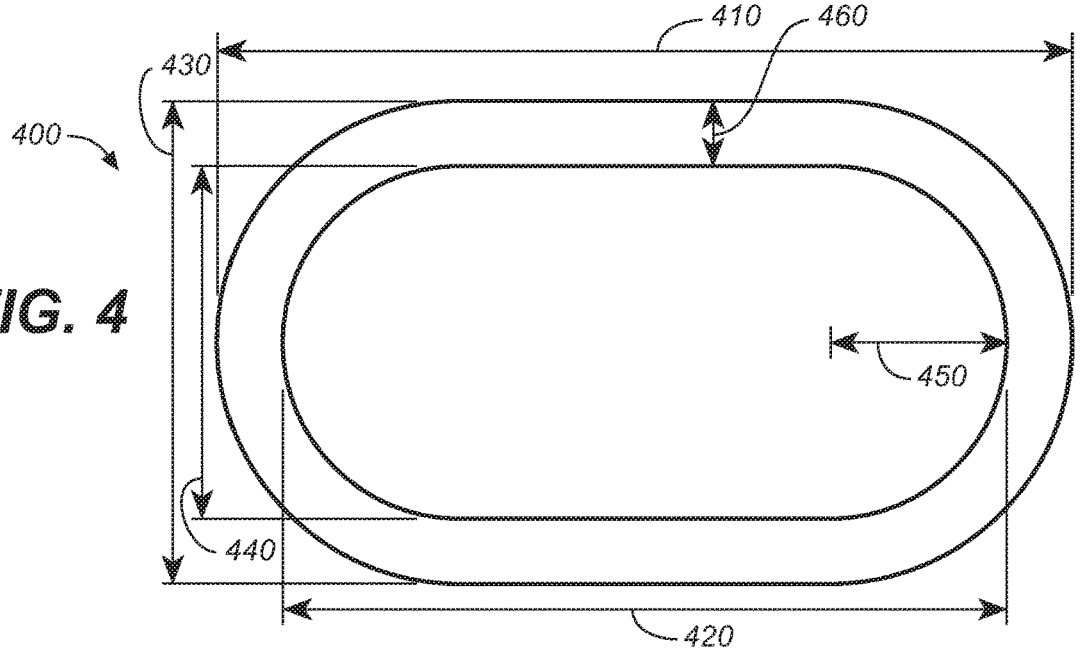
FIG. 4 illustrates an obround cross section of a waveguide having semicircular opposing ends, according to embodiments.

FIG. 4 illustrates an obround cross section of a waveguide 400 (e.g., waveguide 106 of FIGS. 2A and 2B) having semicircular opposing ends, according to embodiments. Waveguide 400 has an outer width 410, an inner width 420, an outer height 430, an inner height 440, and a semicircular radius 450. The thickness 460 of waveguide 400 is equal to outer width 410 minus inner width 420 divided by two, which is also equal to outer height 430 minus an inner height 440 divided by two.

It should be appreciated that the thickness 460 of waveguide 400 is a factor in designing an appropriate waveguide 400. For instance, if the walls of waveguide 400 are too thin, waveguide 400 may deform easily and may not be mechanically stable. If the walls of waveguide 400 are too thick, waveguide 400 may be difficult to bend to shape. In some embodiments, the wall thickness 460 is between 0.20 mm (0.008 inch) to 0.50 mm (0.020 inch). In some embodiments, the ratio of outer height 430 to a thickness 460 of waveguide 400 is between 10/1 and 20/1.

In some embodiments, outer width 410 is between 2.5 mm (0.10 inch) and 5.0 mm (0.20 inch) and outer height 430 is between 1.0 mm (0.040 inch) and 2.5 mm (0.10 inch), such that the wall thickness 460 of waveguide 400 is between 0.20 mm (0.008 inch) to 0.50 mm (0.020 inch). In some embodiments, semicircular radius 450 is between 0.50 mm (0.020 inch) and 1.0 mm (0.040 inch). In an example embodiment, outer width 410 is 3.51 mm (0.138 inch), inner width 420 is 2.97 mm (0.117 inch), outer height 430 is 1.98 mm (0.078 inch), inner height 440 is 1.45 mm (0.057 inch), and semicircular radius 450 is 0.74 mm (0.029 inch), such that the wall thickness 460 of waveguide 400 is 0.27 mm (0.011 inch).

In some embodiments, an obround waveguide is coupled to an interface having a cross section other than an obround cross section. For example, an obround waveguide may be coupled to a waveguide or waveguide interface having a rectangular cross section. In such embodiments, a transition from an obround cross section to a rectangular cross section may be used. In some embodiments, such a transition can be machined or manufactured using electrical discharge machining (EDM).

Example Tool for Manually Bending an Obround Waveguide

Figure 5A:
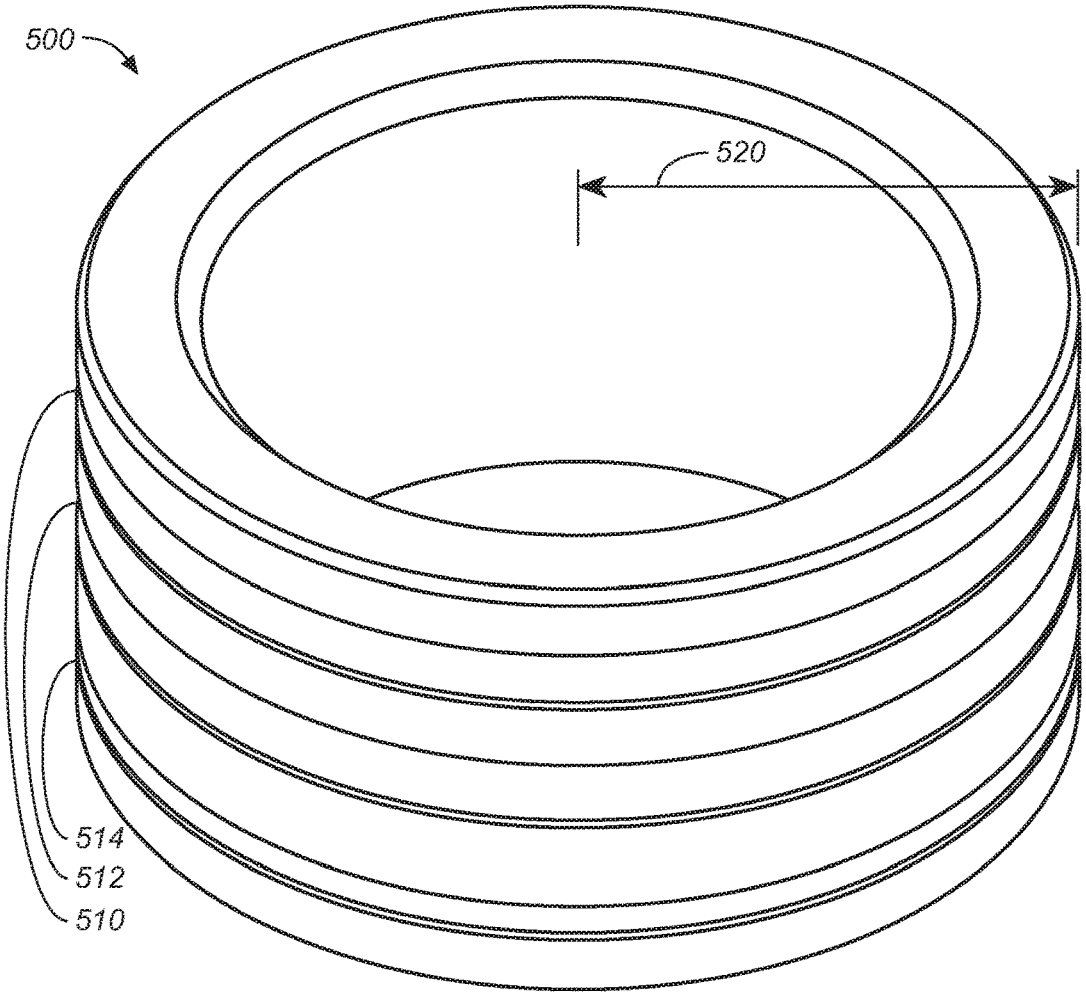
FIG. 5A illustrates a perspective view of a tool for manually bending an obround waveguide, according to embodiments.

FIG. 5A illustrates a perspective view of a tool 500 for manually bending an obround waveguide, according to embodiments. Tool 500 is a cylindrical component having radius 520 (e.g., a radius of curvature). It should be appreciated that tool 500 can be comprised of any rigid material, and may be hollow or solid.

Tool 500 includes grooves 510, 512, and 514 formed in the exterior surface of tool 500 configured for allowing the bending an obround waveguide across different directions. For example, groove 514 is a narrow groove, relative to grooves 510 and 512, for receiving a curved end of an obround waveguide, and bending over the width of the obround waveguide (e.g., a bend in the H direction). Groove 512 is a wide groove, relative to grooves 510 and 514, for receiving a flat side of an obround waveguide, and bending over the height of the obround waveguide (e.g., a bend in the E direction). Groove 510 is an angled groove for receiving an obround waveguide at an angle (e.g., forty five degrees), and bending the obround waveguide according to the angle. While groove 510 as illustrated includes an angle of forty-five degrees, it should be appreciated that groove 510 may include any angle between zero and ninety degrees.

Tool 500 has a radius 520, where radius 520 defines the radius of a bend in an obround waveguide. It should be appreciated that tool 500 can have any radius 520. For instance, a set of tools 500 may include multiple tools 500, each individual tool having the same grooves (e.g., grooves 510, 512, and 514) while having different radius 520 measurements. This would allow a person manually conforming an obround waveguide with flexibility to be able to bend the obround waveguide according to the particular use situation.

Figure 5B:
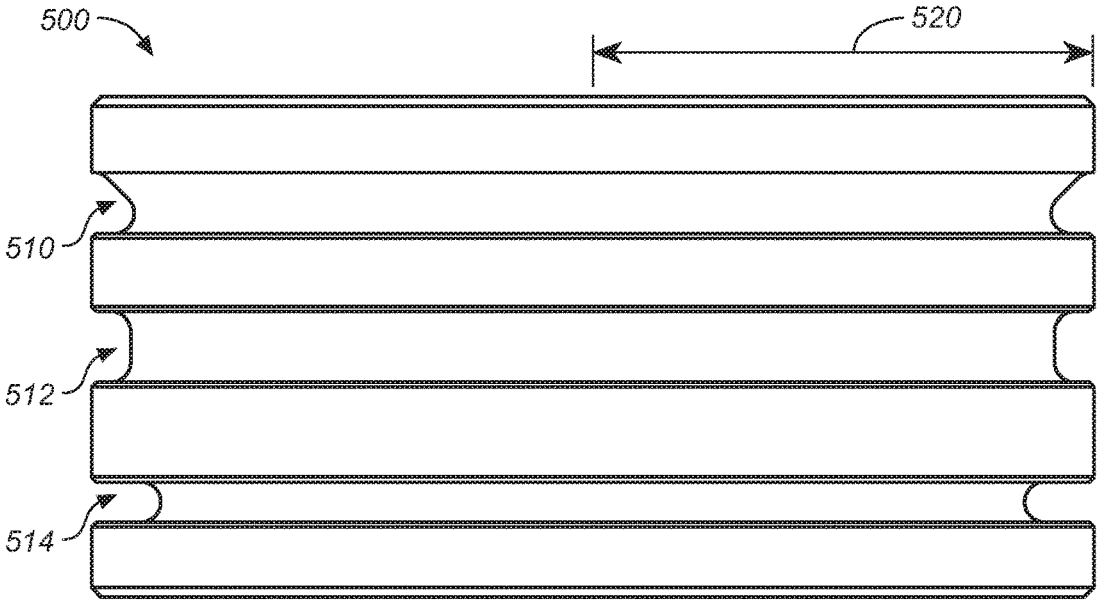
FIG. 5B illustrates a side view of a tool for manually bending an obround waveguide, according to embodiments.

FIG. 5B illustrates a side view of tool 500 for manually bending an obround waveguide, according to embodiments. As illustrated, groove 514 is a narrow groove for receiving a curved end of an obround waveguide, groove 512 is a wide groove for receiving a flat side of an obround waveguide, and groove 510 is an angled groove for receiving an obround waveguide at an angle (e.g., forty five degrees), and bending the obround waveguide according to the angle.

To manually conform a waveguide, a user selects a tool 500 having a desired radius 520. For example, the user would select a tool 500 according to the spacing requirements for placing a conformed waveguide. To use tool 500, a person places an obround waveguide into a selected groove and bends the obround waveguide according to the groove. The radius of the bend of the obround waveguide depends on radius 520 of tool 500.

Example System and Method for Fabricating a Conformable Waveguide

Figure 6:
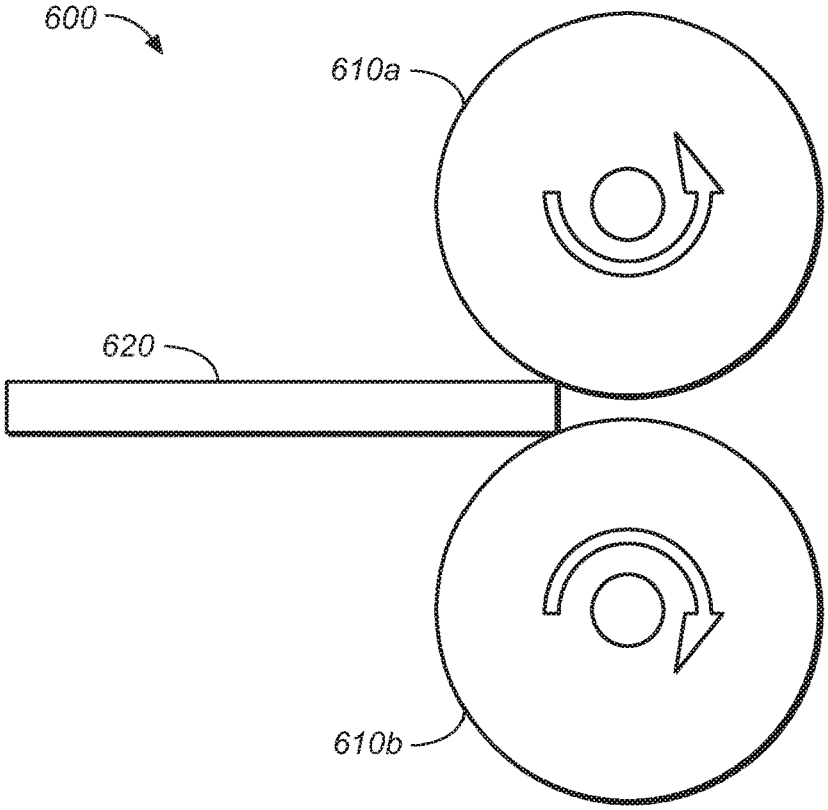
FIG. 6 illustrates an example system for fabricating a conformable waveguide, according to embodiments.

FIG. 6 illustrates an example system 600 for fabricating a conformable waveguide, according to embodiments. System 600 includes upper roller 610*a* and lower roller 610*b*, collectively referred to herein as a set of rollers 610 not specifically labeled in FIG. 6. Set of rollers 610 are for receiving a hollow component 620 and uniformly reducing the thickness of the hollow component according to the separation distance between upper roller 610*a* and lower roller 610*b*.

In some embodiments, system 600 includes a series of sets of metal rollers 610, wherein each successive set of metal rollers 610 has a smaller separation distance. As a hollow component 620 passes through the successive set of metal rollers 610, the thickness of hollow component 620 is reduced. In some embodiments, prior to passing through a set of metal rollers 610, hollow component 620 is a cylindrical hollow component having a cylindrical cross section. In some embodiments, the final set of rollers has a separation distance equal to the outer height 430 of FIG. 4. It should be appreciated that the example shown in FIG. 6 is one example method for fabricating a conformable waveguide, and that many other methods and techniques may be used, as will be understood by those of skill in the art.

Figure 7:
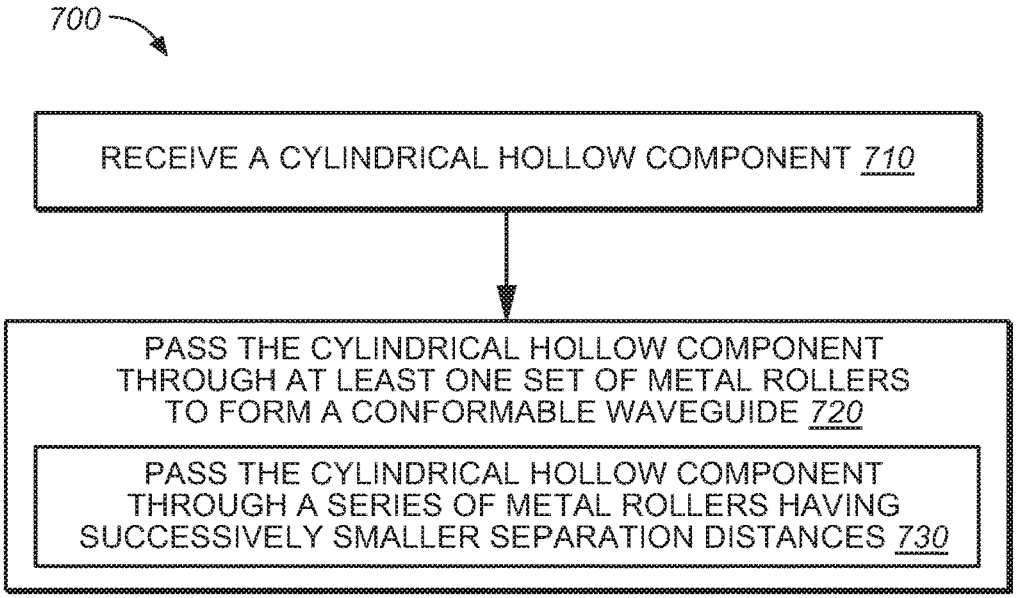
FIG. 7 illustrates a flow diagram of an example method for fabricating a conformable waveguide, according to embodiments.

FIG. 7 illustrates a flow diagram 700 of an example method for fabricating a conformable waveguide, according to embodiments. At procedure 710 of flow diagram 700, a cylindrical hollow component having a smooth interior surface and a cylindrical cross section is received.

At procedure 720, the cylindrical hollow component is passed through at least one set of metal rollers for forming the cylindrical hollow component into a conformable waveguide having an obround cross section. The obround cross section is defined as having parallel opposing sides connected by two rounded opposing ends, wherein the parallel opposing sides are separated by a first distance, wherein vertices of the two rounded opposing ends are separated by a second distance, wherein the second distance is greater than the first distance.

In one embodiment, as shown at procedure 730, the cylindrical hollow component is passed through a series of sets of metal rollers, wherein each successive set of metal rollers has a smaller separation distance, and where a final set of rollers has a separation distance equal to the first distance plus a wall thickness of the conformable waveguide.

In one embodiment, a ratio of the second distance to the first distance is between 1.5/1 and 2/1. In one embodiment, the two rounded opposing ends have semicircular cross sections. In another embodiment, the two rounded opposing ends have semielliptical cross sections. In another embodiment, the two rounded opposing ends have semioval cross sections.

What has been described above includes examples of the subject disclosure. It is, of course, not possible to describe every conceivable combination of components or methodologies for purposes of describing the subject matter, but it is to be appreciated that many further combinations and permutations of the subject disclosure are possible. Accordingly, the claimed subject matter is intended to embrace all such alterations, modifications, and variations that fall within the spirit and scope of the appended claims.

In particular and in regard to the various functions performed by the above described components, systems, methods, and the like, the terms used to describe such components are intended to correspond, unless otherwise indicated, to any component which performs the specified function of the described component (e.g., a functional equivalent), even though not structurally equivalent to the disclosed structure, which performs the function in the herein illustrated examples of the claimed subject matter.

The aforementioned systems and components have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components. Any components described herein may also interact with one or more other components not specifically described herein.

Thus, the embodiments and examples set forth herein were presented in order to best explain various selected embodiments of the present invention and its particular application and to thereby enable those skilled in the art to make and use embodiments of the invention. However, those skilled in the art will recognize that the foregoing description and examples have been presented for the purposes of illustration and example only. The description as set forth is not intended to be exhaustive or to limit the embodiments of the invention to the precise form disclosed.

What is claimed is:

1. A conformable waveguide for conveyance of high frequency radio signals comprising a hollow component having a smooth interior surface and an obround cross section, the obround cross section defined as having substantially straight opposing sides connected by two rounded opposing ends, wherein the conformable waveguide has a uniform wall thickness, wherein the substantially straight opposing sides are separated by a first distance, wherein vertices of the two rounded opposing ends are separated by a second distance, and wherein the second distance is greater than the first distance, wherein the two rounded opposing ends have semielliptical cross sections.

2. The conformable waveguide as recited in claim 1, wherein a ratio of the second distance to the first distance is between 1.5/1 and 2/1.

3. The conformable waveguide as recited in claim 1, wherein a ratio of the first distance to a thickness of the hollow component is between 10/1 and 20/1.

4. The conformable waveguide as recited in claim 1, wherein the substantially straight opposing sides comprise depressions such that the conformable waveguide has a substantially epitrochoid cross section.

5. A method for manufacturing a conformable waveguide for conveyance of high frequency radio signals, the method comprising:

receiving a cylindrical hollow component having a smooth interior surface and a cylindrical cross section;

passing the cylindrical hollow component through at least one set of metal rollers having a respective separation distance for forming the cylindrical hollow component into a conformable waveguide having an obround cross section, the obround cross section defined as having parallel opposing sides connected by two rounded opposing ends, wherein the conformable waveguide has a uniform wall thickness, wherein the parallel opposing sides are separated by a first distance, wherein vertices of the two rounded opposing ends are separated by a second distance, wherein the second distance is greater than the first distance, wherein the passing the cylindrical hollow component through at least one set of metal rollers comprises:

passing the cylindrical hollow component through a series of sets of metal rollers, wherein each successive set of metal rollers has a respective separation distance that becomes successively smaller, and wherein a final set of rollers has a respective separation distance equal to the first distance plus a wall thickness of the conformable waveguide.

6. The method of claim 5, wherein a ratio of the first distance to a thickness of the hollow component is between 10/1 and 20/1.

7. The method of claim 5, wherein a ratio of the second distance to the first distance is between 1.5/1 and 2/1.

8. The method of claim 5, wherein the two rounded opposing ends have semicircular cross sections.

9. The method of claim 5, wherein the two rounded opposing ends have semielliptical cross sections.

10. The method of claim 5, wherein the two rounded opposing ends have semioval cross sections.

11. A tool for manually conforming an obround waveguide, the obround waveguide for conveyance of high frequency radio signals, the obround waveguide comprising a hollow component and an obround cross section, the obround cross section defined as having parallel opposing sides connected by two rounded opposing ends, wherein the parallel opposing sides are separated by a first distance, wherein vertices of the two rounded opposing ends are separated by a second distance, wherein the second distance is greater than the first distance, the tool comprising:

a cylindrical component having a radius of curvature, the cylindrical component comprising at least one groove formed in an exterior surface of the cylindrical component, the at least one groove configured to receive therein the obround waveguide;

wherein the obround waveguide is conformed to be a conformed obround waveguide with a bend having the radius of curvature responsive to a person manually conforming the obround waveguide into the at least one groove.

12. The tool for manually conforming an obround waveguide of claim 11, wherein the at least one groove is configured to receive a parallel side of the parallel opposing sides of the obround waveguide, such that the obround waveguide is conformed over the first distance.

13. The tool for manually conforming an obround waveguide of claim 12, wherein the at least one groove has a width that corresponds to the second distance.

14. The tool for manually conforming an obround waveguide of claim 11, wherein the at least one groove is configured to receive the obround waveguide at an angle, such that the obround waveguide is conformed according to the angle.

15. The tool for manually conforming an obround waveguide of claim 14, wherein the angle is forty-five degrees.

16. The tool for manually conforming an obround waveguide of claim 11, wherein the at least one groove is configured to receive a rounded end of the two rounded opposing ends of the obround waveguide, such that the obround waveguide is conformed over the second distance.

17. The tool for manually conforming an obround waveguide of claim 16, wherein the at least one groove has a width that corresponds to the first distance.

18. A conformable waveguide for conveyance of high frequency radio signals comprising a hollow component having a smooth interior surface and an obround cross section, the obround cross section defined as having substantially straight opposing sides connected by two rounded opposing ends, wherein the conformable waveguide has a uniform wall thickness, wherein the substantially straight opposing sides are separated by a first distance, wherein vertices of the two rounded opposing ends are separated by a second distance, and wherein the second distance is greater than the first distance, wherein a ratio of the first distance to a thickness of the hollow component is between 10/1 and 20/1.

19. The conformable waveguide as recited in claim 18, wherein the two rounded opposing ends have semicircular cross sections.

20. The conformable waveguide as recited in claim 18, wherein the two rounded opposing ends have semielliptical cross sections.

21. The conformable waveguide as recited in claim 18, wherein the two rounded opposing ends have semioval cross sections.

22. The conformable waveguide as recited in claim 18, wherein the substantially straight opposing sides comprise depressions such that the conformable waveguide has a substantially epitrochoid cross section.

* * * * *